United States Patent [19]

Soulier

[11] Patent Number: 4,986,337

[45] Date of Patent: Jan. 22, 1991

[54] APPARATUS FOR GRAVITY-FEED CASTING WITH A LARGE NUMBER OF INGOT MOLDS OF METAL OF METAL BILLETS OF MULTIPLE DIAMETERS

[75] Inventor: Roger Soulier, Voiron, France

[73] Assignee: Aluminium Pechiney, Paris, France

[21] Appl. No.: 466,637

[22] Filed: Jan. 17, 1990

Related U.S. Application Data

[63] Continuation-in-part of Ser. No. 259,808, Oct. 19, 1988.

[30] Foreign Application Priority Data

Nov. 13, 1987 [FR] France ..... 87 16298

[51] Int. Cl.[5] ..... B22D 11/00

[52] U.S. Cl. ..... 164/420; 164/437

[58] Field of Search ..... 164/437, 439, 420, 444, 164/486, 487, 472

[56] References Cited

U.S. PATENT DOCUMENTS 3,780,789 12/1973 Unger ..... 164/420

4,597,432 7/1986 Collins ..... 164/487

4,693,298 9/1987 Wagstaff ..... 164/486

*Primary Examiner*—Richard K. Seidel

*Assistant Examiner*—Rex E. Pelto

*Attorney, Agent, or Firm*—Dennison, Meserole, Pollack & Scheiner

[57] ABSTRACT

The invention relates to an apparatus for gravity feed casting with a large number of ingot molds of metal billets of multiple diameters, and including one or more rows of ingot molds. According to the invention, each ingot mold rests freely on a cooling cell and includes a feeder head which is fixed to a removable base plate which serves as a support for liquid metal feed ducts and removable housings. The base plate includes a plurality of openings communicating between a feed duct and at least one feeder head. A housing is provided on the base plate for each opening, with each housing including one aperture for each feeder head with which the opening corresponding to the housing communicates. The use of this apparatus makes it possible to change one or more ingot molds while reducing the risk of explosion.

6 Claims, 3 Drawing Sheets

APPARATUS FOR GRAVITY-FEED CASTING WITH A LARGE NUMBER OF INGOT MOLDS OF METAL BILLETS OF MULTIPLE DIAMETERS

The present application is a continuation-in-part of copending U.S. Pat. application Ser. No. 259,808, filed Oct. 19, 1988.

BACKGROUND OF THE INVENTION

The present invention relates to an apparatus for gravity-feed casting with a large number of ingot molds of metal billets of multiple diameters comprising at least two parallel rows of ingot molds.

Those skilled int he art are well aware of the process for continuous casting of metals in which molten metal is introduced into an externally cooled ingot mold provided with a movable bottom. While it is in the ingot mold, the metal sets and is discharged downwardly by means of the movable bottom while the ingot mold is supplied with fresh molten metal in its upper part so as to maintain an approximately constant level of molten metal in the mold.

To remedy certain operating difficulties many improvements have been made in that procedure such as those taught in French patent No. 1 364 776 and which comprise placing a reserve of liquid metal above the ingot mold in order to ensure that the dress or oxides which float on the free surface of the metal are not entrained into the resulting product where they would give rise to serious flaws. That gravity-feed reserve of metal which is also referred to as the feeder head reserve or "hot-top," also has the advantage of forming billets with a good surface condition. The use of a feeder head reserve or "hot-top" has been the subject of particular development in multiple-pouring apparatus since, with a single control in respect of level, it makes it possible to provide simultaneously for pouring metal into several tens of ingot molds at a time.

Generally, the feeder head overhangs the inside wall of the ingot mold, and means for continuously injecting gas or lubricant are disposed at the interface thereof to facilitate the casting operation and to improve the quality of the products produced. The following references are concerned with particular aspects of this invention.

In U.S. Pat. No. 3,381,741, the feed reservoir and the ingot mold are connected by way of a relatively thin, heat-conducting insert and means for introducing lubricant within the mold are disposed between the insert and the mold.

In U.S. Pat. No. 4,157,728, a gas is introduced below the overhang so as to apply a pressure to the periphery of the metal and a lubricating surface is provided within the mold by the introduction of a lubricant just below the means for introducing gas.

In U.S. Pat. No. 4,598,763, a flow of gas under pressure is supplied at a point disposed outside the cavity of a mold, the gas is discharged into the cavity at a point disposed at the periphery thereof and means such as a graphite ring are interposed between the supply point and the point of discharge on the outside of the cavity, to convert the flow of gas into a ring of fluid extending around the metal mass at the periphery of the cavity. In addition, lubricating oil is passed into the casting ladle, preferably passing through the overhang portion which is at the top of the ladle.

As applicants were concerned with the problem of casting metals using the gravity-feed or hot-top process and in particular casting billets of aluminum or aluminum alloy, it was noted on studying these references that the teaching thereof involved either using a continuous lubricating means and/or, when using gas under pressure, injection of the gas at the actual level of the ingot mold, by means of sophisticated regulating systems intended to prevent the pressure from rising beyond a limit which would give rise to movements within the liquid metal.

Being aware of the constraints imposed by these processes, applicants previously developed a simpler process and apparatus in which there is no need for continuous lubrication and the gas injection system is easier to regulate. These improvements were disclosed in EP No. 213 049 which was directed to the application of an inert gas pressure to the lower part of the periphery of the feeder head throughout the casting operation and the use of a feeder head formed by two parts which are connected together by way of a joint, with the lower part of the feeder head surrounded over its entire periphery by an annular chamber connected to a source of inert gas under pressure. These improvements contributed to a substantial improvement in the operation of casting installations and also the quality of the resulting products. However, there were still other problems which arose with the prior art apparatus which had to be overcome, in particular:

(1) Limiting the risks of explosion which are inherent in such installations. As in most casting apparatus, the metal which is undergoing solidification sticks to the wall of the mold and, by virtue of the fact that the metal is pulled downwardly under its own weight, can give rise to a movement of the mold which comes away from the feeder head. Thereby a space is created through which the cooling water can come into contact with the liquid metal and cause an explosive reaction; that danger was the subject of a communication from the Aluminum Association;

(2) In the case of installations having a plurality of flow passages, reducing the periods of time required for changing ingot molds, which are generally long and harmful to the level of productivity; and (3) Providing the possibility of casting different formats while having to change only the ingot molds and the movable bottoms.

SUMMARY OF THE INVENTION

In order to achieve a solution to these problems, an apparatus is provided which can be used with all ingot molds employing a cooling system different from the water jacket system, including the molds which were the subject-matter of FIG. 1 of EP No. 213,049.

The invention therefore provides an apparatus for gravity feed casting with a plurality of ingot molds of metal billets of multiple formats, the apparatus comprising:

at least one row of ingot molds each provided with side and upper walls, and a movable bottom;

a corresponding cooling cell disposed externally to and spaced from the side wall of each mold each mold resting freely on a corresponding cooling cell, and bearing against the corresponding cell by way of a seal;

a feeder head having a base provided with an outwardly directed rim resting on the upper wall of each mold by means of a seal;

a removable base plate disposed above the molds supporting liquid metal feed ducts, the base plate including a plurality of openings, each opening communicating between a feed duct and at least one feeder head;

a removable housing provided on the base plate for each opening, each housing including one aperture for each feeder head with which the opening corresponding to the housing communicates, each aperture being aligned with an opening and a feeder head which is engaged into the opening, the rim of the feeder head being fixed beneath the corresponding housing, the removable housings being separate from each other;

means fixing each housing to the base plate; and a plurality of interconnected refractory blocks fixed with respect to each of the housings and forming the ducts.

In a particular embodiment, there are two parallel rows of ingot molds. Each opening is then extended to communicate with the feeder heads of two adjacent molds, one of the adjacent molds being in each row.

The essential features of the invention comprise first, using the cooling cell which extends around the ingot mold as a support therefor. Thus, any entrainment effect of the ingot mold with the product as it solidifies and any possibility of the cooling water having access to the liquid metal contained in or above the ingot mold is obviated. In addition, the ingot mold is engaged sliqhtly within the internal wall of the cooling cell and bears against same by way of a joint so as to ensure that the water cannot be directed upwardly, thus enhancing the safety aspect.

That particular arrangement of the mold combined with the other means of the invention makes it possible to facilitate dismantling operations using the basic tooling.

In fact, as the ingot mold is free of any mechanical tie, it can be easily separated from its support, from above, in order to be changed. However, that is possible only if it is accessible, that is to say if the assembly of the feeder head and the feed ducts can be moved.

The invention provides two embodiments when there is a need to change the format of the billets being cast, one which makes it necessary to remove all the inqot molds, the other when the situation involves simply replacing a defective ingot mold or performing an operation relating to a movable bottom, or dealing with any localized incident.

In the first case, the means involve using a removable base plate, that is to say, a plate which can be lifted, for example, by means of rings which are fixed with respect to its upper surface or which can be pivoted about a fixed axis on one of its sides. As that plate supports an assembly of housings to which the rims of the feeder heads and the assembly of feed ducts are connected, displacement thereof makes it possible to gain access to all of the ingot molds.

In the other case, the base plate remains in position and it is only necessary to free the removable housing and to provide means for lifting it or pivoting it about a fixed axis along one of its sides.

When it moves, the housing entrains therewith either a feeder head in the case of a single row or at least two feeder heads disposed above ingot molds arranged perpendicularly to the rows, and the portions of corresponding feed ducts, the latter being such that they can be disengaged from interconnecting wedge portions of refractory material which rest on the base plate.

In installations in which the feeder head is made up in two parts, such as EP 213,049, it is the upper part only of the feeder head which is fixed with respect to the housing.

BRIEF DESCRIPTION OF THE DRAWINGS

The invention can be illustrated by reference to the accompanying drawings relating to an apparatus of the type having a feeder head which is in two parts. In the drawings

DESCRIPTION OF THE PREFERRED EMBODIMENTS

Figure 1:
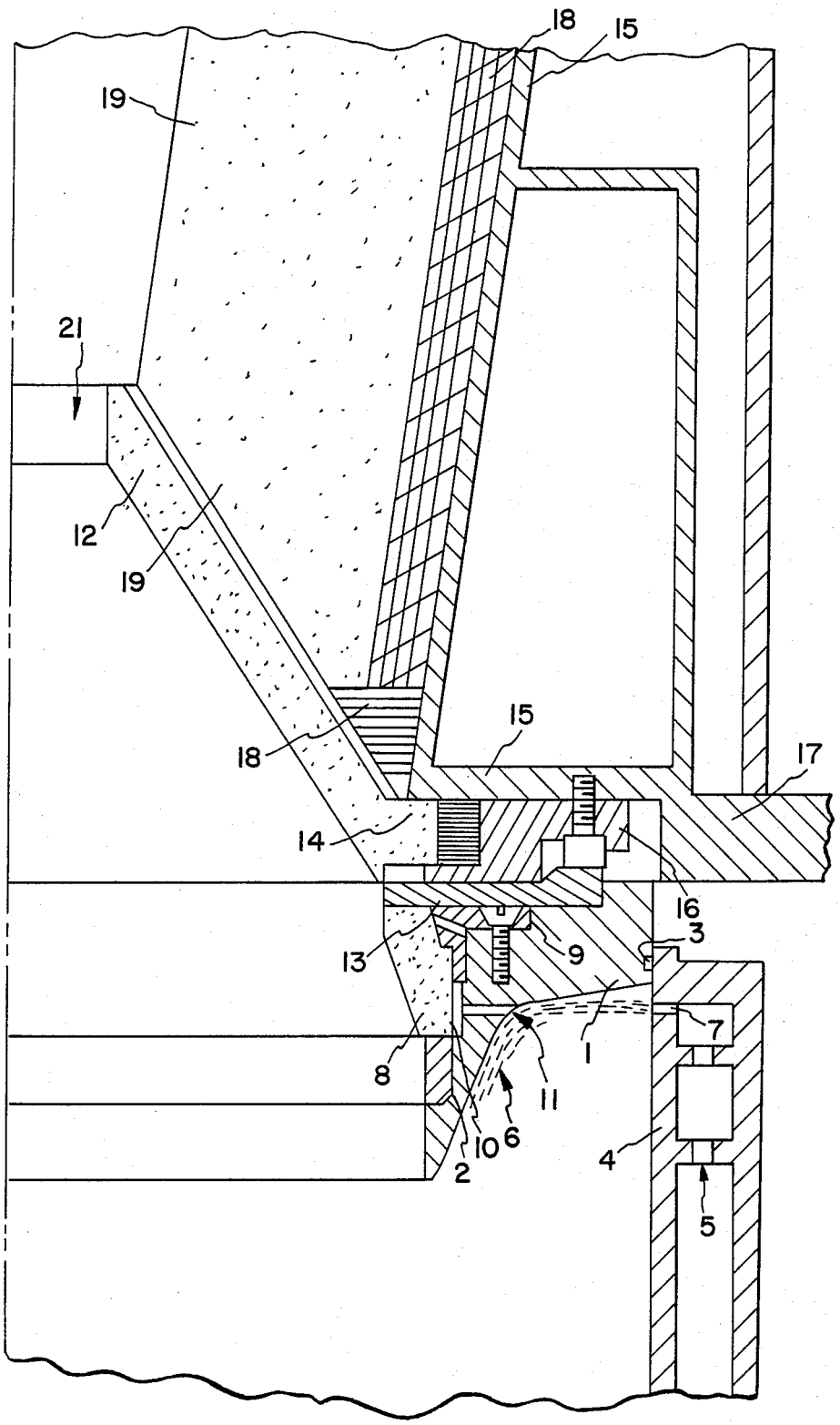
FIG. 1 is a view in vertical axial section of a portion of an ingot mold located as part of an apparatus according to the invention.
Figure 2:
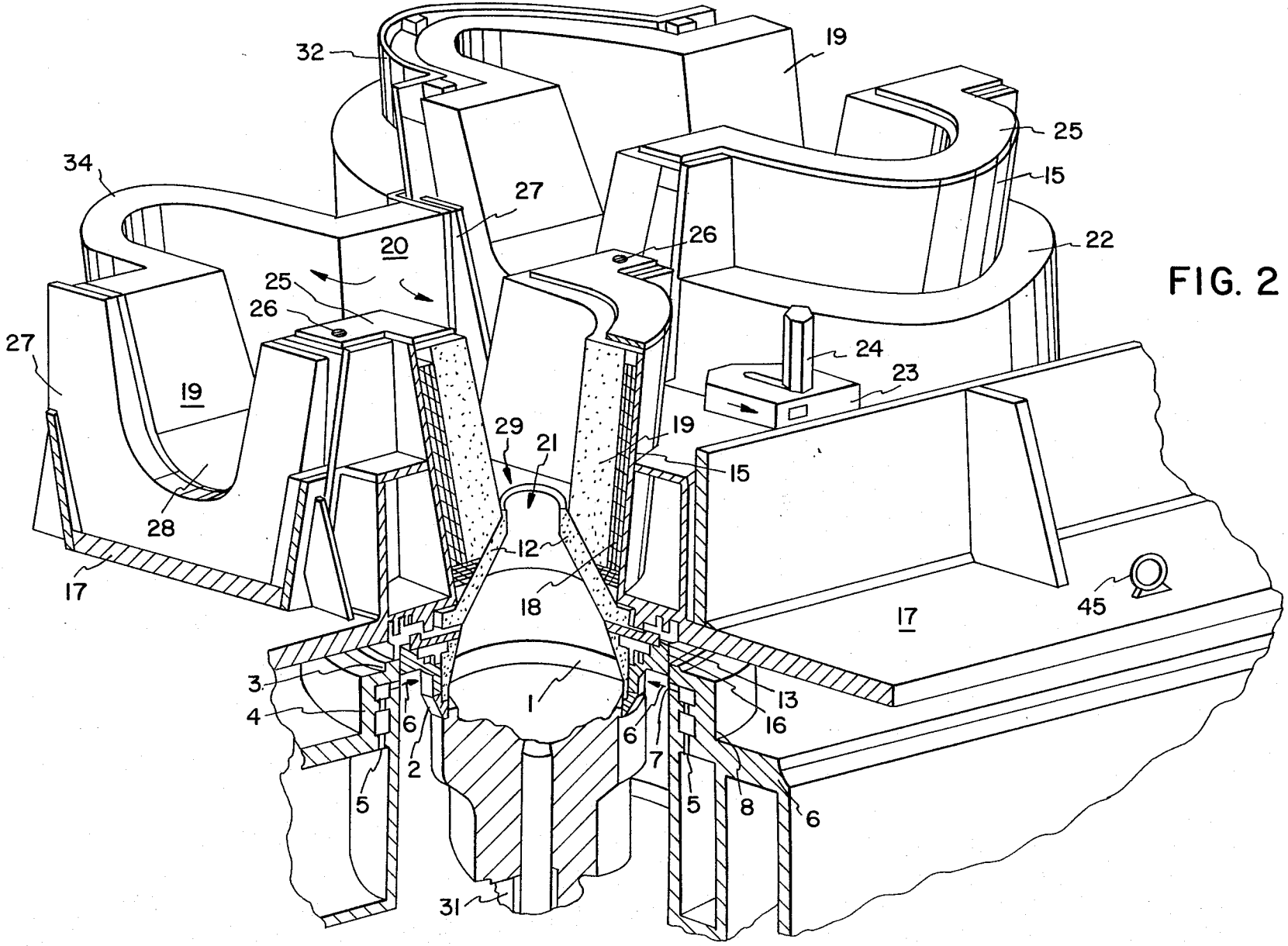
FIG. 2 is a cut-away perspective view of the apparatus of the invention.

Referring to FIGS. 1 and 2, there is shown an ingot mold I which is internally lined with a graphite ring 2, and which rests and is supported by way of a joint 3 against a cooling cell 4 supplied with water as indicated at 5 and which applies a jet of water 6 to the outside wall of the ingot mold by way of a slot 7.

The ingot mold is fitted with a feeder head in two parts:

a lower part 8 which is disposed in overhanging relationship with the ring and which is held fixed with respect to the mold by a fixing means 9 and the outside face of which is surrounded over a fraction of its height by an annular chamber 10 connected to a source of inert gas under pressure by means of the conduit system 11: and an upper part 12 which rests on the lower part 8 by way of a joint 13, a rim 14 thereof being fixed to a housing 15 by a fixing means 16, the housing 15 resting on a base plate 17 and being covered with an insulating material 18 and a refractory block 19 forming the bottom of the pouring ducts over which the liquid metal flows as indicated by arrows 20 before feeding aperture 21 aligned with the ingot mold feeder head.

Figure 3:
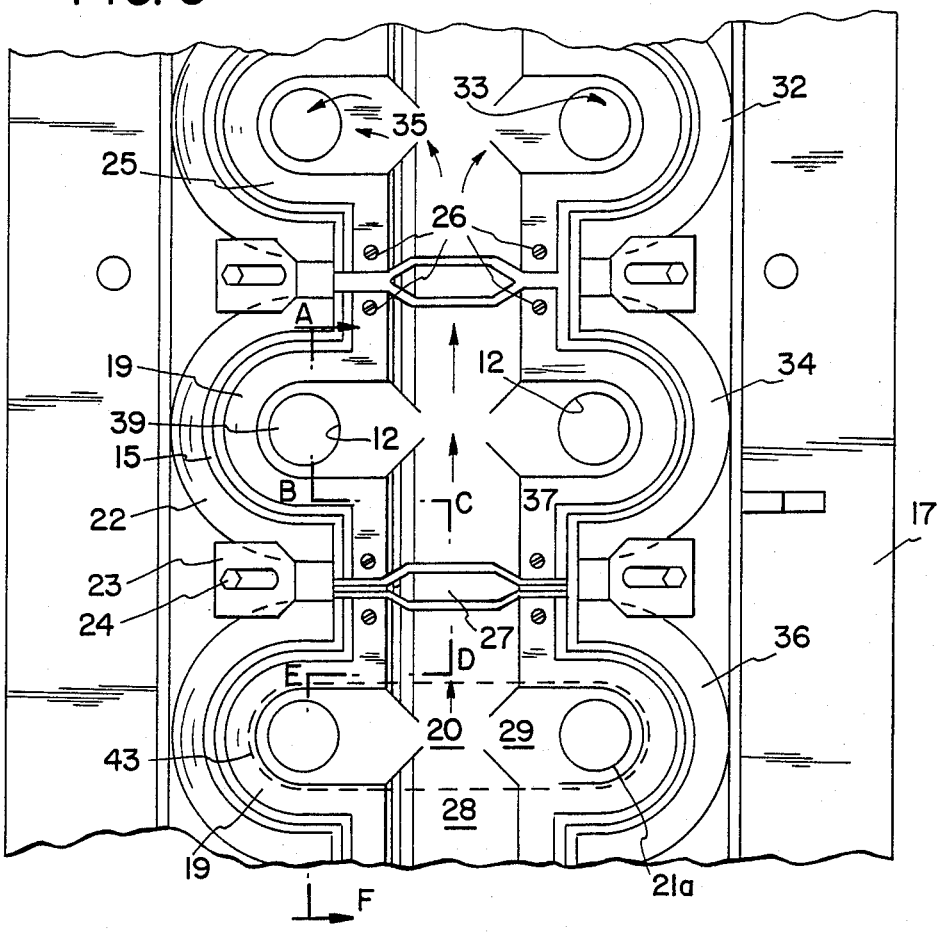
FIG. 3 is a top view of an apparatus according to the invention comprising two parallel rows of serial ingot molds.
Figure 4:
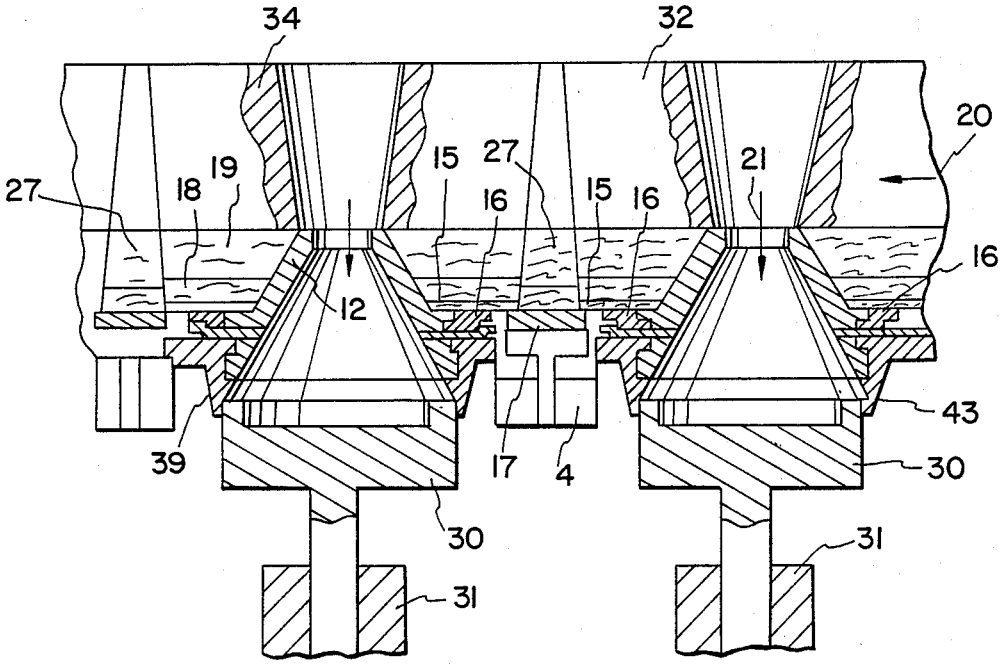
FIG. 4 is a view in vertical section taken along line A-B-C-D-E-F of FIG. 3, passing through the axes of two adjacent ingot molds of a series and the molten metal duct between the two ingot molds.

FIGS. 2, 3 and 4 show a mold assembly comprising several sets of parallel molds located in series, each set of parallel molds having a duct structure thereabove forming a duct leading to the entrance of each mold and to the next duct structure in the series. Thus, duct structure 32 is located above parallel molds 33 and 35, duct structure 34 is located above parallel molds 37 and 39, and duct structure 36 is located above parallel molds 41 and 43. The duct structures cooperate to form a central duct 28 having branches 29 leading to the aperture aligned with the feeder head of each mold.

The support of the apparatus is formed by base plate 17 on which duct structures 32, 34 and 36 rest. The duct structures include housing portions 15, intermediate insulating materials 18 covering the housing portions and refractory blocks 19 which line the ducts 28 and come into contact with the molten metal. Housings 15 includes horizontally extending flat portions 22 which are held together and to the base plate 17 by clamps 23 comprising bolts and screw-threaded rods as shown at 24.

The exposed upwardly facing portions of the housing portions 15 and refractory blocks 19 are at least partially covered by cover members 25 which are bolted at 26 to the refractory blocks to hold the duct structures in place.

Each duct structure covers two adjacent parallel molds. Adjacent duct structures are separated by wedge portions 27 of refractory material, which together with the duct structures form central ducts 28 for feeding molten metal in the direction of arrows 20, from one pair of parallel molds to the next pair in the series. Branch ducts 29 lead to apertures 21 in the duct structure, each aperture 21 being disposed above a feeder head. Opening 21*a* in the base plate extends below and between a pair of apertures 21, and above a pair of parallel molds.

FIG. 4 shows in cross-section the structure of series ingot molds 33 and 37, each cell including a movable bottom 30 which is displaced in a cylinder 31. Each cooling cell 4 is disposed under a wedge portion 27 and directs cooling water towards each of the molds in series to which it is adjacent.

Access to all molds in a particular series can be obtained by lifting base plate 17, for example, by lifting ring 45. When the base plate 17 is removed, all housings 15 thereabove are carried with it, as are the upper portions 12 of the feeder heads. Alternatively, access to a single mold or to a pair of parallel molds can be obtained by detaching wedge portions 27, separating a housing 15 from the base plate 17, and lifting only the housing, which carries with it the upper portion 12 of the feeder head or heads covered by the housing.

While avoiding the risks of explosion, the present invention makes it possible to reduce to less than two hours the period of time required for changing the format of billets of a diameter of 200 to 190 mm in an apparatus formed by three parallel rows of ingot molds, each row containing 30 molds.

What is claimed is:

1. A continuous casting apparatus for multiple gravity feed casting said apparatus comprising:

at least one row of ingot molds each provided with side and upper walls and a movable bottom;

a corresponding cooling cell disposed externally to and spaced from the side wall of each said mold each said mold resting freely on a corresponding cooling cell and bearing against the corresponding cell by way of a seal;

a feeder head having a base provided with an outwardly directed rim resting on the upper wall of each said mold by means of a seal;

a removable base plate disposed above said molds supporting ducts for feeding liquid material said base plate including a plurality of openings, each said opening communicating between a said duct and at least one said feeder head, a removable housing provided on said base plate for each of said opening, each housing including one aperture for each feeder head with which the opening corresponding to the housing communicates, each said aperture being aligned with an opening and a feeder head which is engaged into the opening, the rim of the feeder head being fixed beneath the corresponding housings, said removable housing being separable from each other;

means fixing each said housing to said base plate; and a plurality of interconnected refractory blocks fixed with respect to each of said housings forming said ducts and having apertures therein corresponding to the apertures in the housing and the openings in the base plate.

2. Apparatus according to claim 1, comprising at least two parallel rows of ingot molds wherein each said opening is extended to communicate with the feeder heads of at least two adjacent molds, one of said adjacent molds being in each row.

3. Apparatus according to claim 1, additionally comprising means attached to said base plate for lifting said base plate.

4. Apparatus according to claim 1, wherein said refractory blocks intercepted by wedge portions of refractory material resting on said base plate.

5. Apparatus according to claim 2, additionally comprising means attached to said base plate for lifting said base plate.

6. Apparatus according to claim 2, wherein said refractory blocks are interconnected by wedge portions of refractory material resting on said base plate.

* * * * *